United States Patent [19]

Jones et al.

[11] Patent Number: 4,526,699

[45] Date of Patent: Jul. 2, 1985

[54] ENCAPSULATED BLEACH COMPOSITION AND METHOD OF PREPARATION

[75] Inventors: Charles E. Jones, Yardley; Mark A. Weiss, Fairless Hills, both of Pa.

[73] Assignee: FMC Corporation, Philadelphia, Pa.

[21] Appl. No.: 542,797

[22] Filed: Oct. 17, 1983

[51] Int. Cl.[3] ..... C11D 7/56

[52] U.S. Cl. ..... 252/99; 252/186.35; 252/174.13; 427/213; 427/214; 427/215; 428/403

[58] Field of Search ..... 252/174.13, 99, 186.34, 252/186.35, 186.36, 186.37; 427/213, 214, 215; 428/403

[56] References Cited

U.S. PATENT DOCUMENTS

| | | | |
|---|---|---|---|
| 2,977,314 | 3/1961 | Stephanou et al. | 252/99 |
| 2,980,622 | 4/1961 | Symes | 252/99 |
| 3,093,590 | 6/1963 | Ferris | 252/99 |
| 3,112,274 | 11/1963 | Morgenthaler et al. | 252/99 |
| 3,281,370 | 10/1966 | Coward et al. | 252/187 |
| 3,449,254 | 6/1969 | Suiter | 252/99 |
| 3,474,037 | 10/1969 | Goldsmith | 252/99 |
| 3,494,868 | 2/1970 | Gray | 252/99 |
| 3,538,005 | 11/1970 | Weinstein et al. | 252/99 |
| 3,650,961 | 3/1972 | Hudson | 252/99 |
| 3,741,904 | 6/1973 | Christensen et al. | 252/99 |
| 3,860,525 | 1/1975 | Bechtold | 252/99 |
| 4,048,351 | 9/1977 | Saeman et al. | 427/213 |
| 4,194,025 | 3/1980 | Klebe et al. | 427/215 |
| 4,279,764 | 7/1981 | Brubaker | 252/99 |
| 4,321,301 | 3/1982 | Brichard et al. | 428/403 |

*Primary Examiner*—Prince E. Willis

*Attorney, Agent, or Firm*—Richard E. Elden; Eugene G. Horsky

[57] ABSTRACT

Bleaching compositions consisting of an N-halo compound with a coating comprising a silicate bound, hydrated, soluble inorganic salt and an alkali metal salt of boric acid. The compositions exhibit decreased localized dye attack on colored fabrics and decreased fabric attack and are useful in fabric laundering either alone or when formulated with a laundry detergent.

20 Claims, No Drawings

ENCAPSULATED BLEACH COMPOSITION AND METHOD OF PREPARATION

This invention relates to solid available halogen bleaching compositions which minimize localized fabric damage, and in the case of colored fabrics, also minimize localized dye attack.

It is well known that solid available halogen bleach compositions when used during laundering can cause fabric damage as well as localized dye attack on colored fabrics. These problems are particularly prevalent when the formulation containing the bleach composition is either added to a load of dry laundry or added into a clothes washer during its filling cycle.

In addition, when available halogen bleaching agents are formulated into a laundry detergent, some of the organic components such as surfactants and perfumes, can react with the halogen to cause a decrease in available chlorine and general cleaning effectiveness. These and other deficiencies of N-halo bleach compositions are summarized by Brubaker in U.S. Pat. No. 4,279,764 which is incorporated herein in its entirety. Brubaker teaches the incorporation of an N—H chlorine-accepting compound into a silicate-bound, hydrated soluble salt coating. Such N—H chlorine-accepting compounds, although effective, add to the cost of a bleach formulation and decrease the overall efficacy of the bleach or detergent compared with a formulation absent said N—H compound.

Encapsulation of calcium hypochlorite products is taught by Saeman et al in U.S. Pat. No. 4,048,351 using molten, hydrated inorganic salts as a means to prevent dusting and to resist degradation by organics. The process of Saeman et al, while useful for coating alkaline inorganic hypochlorites, is not known to be applicable to organic N-halo compositions nor to produce a product useful to prevent fabric and dye attack.

In accordance with the present invention, there is provided an N-halo bleach composition which minimizes both local dye attack on colored fabrics and localized fabric damage. The composition comprises particles of a halogen bleaching agent having at least one N-halo atom capable of releasing a hypohalite ion to an aqueous solution, such particles being coated with a sufficient quantity of a soluble hydrated silicate-bound inorganic salt in admixture with a soluble, alkali metal salt of boric acid so that the ratio of the N-halo atoms to the boron atoms range from about 0.5:1 to about 10:1.

The alkali metal salt of boric acid serves as a coating aid for encapsulating the N-halo bleaching agent and also, but unexpectedly, appears to control or mitigate the hypohalite ion formed by contact of the N-halo bleaching agent with the aqueous solution. This mitigating effect further decreases the possibility of localized dye attack and fabric damage. In addition, the presence of the alkali metal salt of boric acid enhances the detergency of the laundry wash water.

Although alkali metal salts of boric acid have been used to form dry borate-hypochlorite compositions by Stephanou et al in U.S. Pat. No. 2,977,314, no such control or mitigation effect was observed. However, the present invention differs substantially in composition from the teaching of Stephanou et al and the alkali metal salt of boric acid is used for a different function by Stephanou et al.

It is well known that the anion formed by dissolving an alkali metal salt of boric acid is dependent on the pH of the solution. Therefore, one skilled in the art will recognize that any alkali metal salt of boric acid may be used to practice the present invention. Desirably, the alkali metal cation will be one of the more available alkali metals, such as lithium, sodium, and potassium.

For economy, it is preferable that the boric acid salt used in the practice of this invention contain a sodium cation. Suitable sodium salts include, but are not limited to, disodium tetraborate pentahydrate, disodium tetraborate tetrahydrate, disodium tetraborate, sodium pentaborate pentahydrate, sodium metaborate tetrahydrate, sodium metaborate dihydrate, and disodium octaborate tetrahydrate or mixtures thereof.

The N-halo compound is desirably an N-chloro compound although N-bromo and N-iodo compounds may be preferred where optimum germicidal activity is desired. Normally, the N-chloro compounds will be an oxidant of the type which releases chlorine under detergent bleaching conditions, such as potassium dichloroisocyanurate, sodium dichloroisocyanurate and hydrates, as well as other N-chloro compounds, such as those disclosed in U.S. Pat. No. 4,279,764.

Suitable hydratable inorganic salts are sodium carbonate, trisodium phosphate, disodium phosphate, sodium sulfate and condensed polyphosphates, such as $Na_4P_2O_7$ and $Na_5P_3O_{10}$; partial hydrates of these salts can also be used.

The alkali metal silicate encapsulating liquid is conveniently a sodium silicate solution having a $SiO_2/Na_2O$ ratio of from about 3.2:1 to about 2.4:1 and a total solids content of from about 1.0–50%. Preferred solutions contain 20–35% solids with a $SiO_2/Na_2O$ ratio of from about 2.8:1 to about 3.2:1. The encapsulated bleach product may include inert ingredients, such as sodium alumina silicates, sodium sesquicarbonate, sodium bicarbonate, sodium chloride, silica flour, and salts of organic acids.

The preferred ratio of N-halo atoms to boron atoms in the composition will vary according to the degree of chlorine mitigation and detergency desired in the solution, as well as the concentration of hypohalite ion desired in the solution. Normally, when an available chlorine compound is used in laundry wash or rinse water, a concentration of 10 to 200 milligrams per liter (mg/1) available chlorine is desirable. The preferred range is 15 to 150 mg/1 as this concentration is the most effective use level of a chlorine bleach agent.

It has been found that the ratio of N-halo atom to the boron atom in the composition is desirably from about 0.5:1 to about 10:1. A ratio of less than 0.5:1 may be used but at a sacrifice in economy as a large quantity of the composition is required to attain the desired available chlorine concentration. A ratio above 10:1 provides insufficient mitigation to protect against the localized dye attack; a ratio of from 1:1 to 5:1 is preferred as it includes the most economical, effective, and safe range.

The encapsulated halogen bleach product herein is prepared in the known manner of applying a silicate-bound, hydrated salt coating to particulate halogen bleaching agents. Generally, such a procedure, commonly referred to as agglomeration, involves contacting finely-divided, soluble anhydrous inorganic salt with aqueous alkali metal silicate in the presence of the halogen bleach particles while maintaining some form of agitation. On contact with the aqueous silicate, the anhydrous salt undergoes hydration to give hydrated salt particles which are bound together by the silicate into agglomerates containing embedded bleach particles.

Agglomeration of the solids aforesaid may be accomplished by spraying the solids with a mist of the silicate solution during agitation. The contacting may also be effected by pouring or dripping the liquid onto the solids. Whichever way the contacting is carried out, the solids should be constantly in motion so there is intimate contact between the solid particles and the agglomerating silicate solution. Moving beds, which have been found satisfactory, include such well-known devices as paddle and blade-type mixers, rotating drums, and inclined discs. The agglomerated product is then dried either in vacuum or in air. Preferably, the product is dried at a temperature of about 20° C. to 50° C. after which it can be packaged as such or added to a detergent formulation. Although a single coating on the N-halo bleaching agent is sufficient for most applications, at least one additional coating may be desirable. The second coating may consist of an alkali metal silicate alone, particularly when the composition is intended for use with delicate fabrics. The added alkali metal silicate coating can provide further hydration and additional silicate for binding the hydrated salt.

One familiar with the art will recognize that it is desirable that the mean particle size of a compound used for the coating is smaller than the mean particle size of the N-halo compound to minimize the quantity of coating compound required.

Although the encapsulated bleaches prepared in accordance with the invention can be added to the wash solution, they are conveniently introduced as a component of the detergent or soap formulation. Suitable formulation and ingredients are disclosed in U.S. Pat. No. 4,279,764, which is incorporated herein.

Such formulations will comprise by weight, from about 5% to about 50% of the herein bleach system, from about 5% to 50% of the detergent agent, and optionally, from about 1% to 60% of a detergency builder, which can also function as a buffer to provide the requisite pH range when the composition is added to water.

The compositions herein can include detergent adjunct materials and carriers commonly found in laundering and cleaning compositions. For example, various perfumes, optical brighteners, fillers, anti-caking agents, fabric softeners, and the like, can be present to provide the usual benefits occasioned by the use of such materials in detergent compositions. Enzymes, especially the thermally stable proteolytic and lipolytic enzymes used in laundry detergents, also can be dry-mixed in the compositions herein.

The examples which follow are presented to illustrate the best mode of practicing the invention but are not to be construed to limit the invention to the examples. For convenience, the examples are described in terms of sodium dichloroisocyanurate dihydrate as the N-halo compound, with a sodium carbonate as the hydratable salt, and using a commercial sodium silicate liquid with a silica to sodium oxide ratio of 3:22 containing 28.7% silica.

The following tests were used to evaluate the compositions:

LOCALIZED DYE ATTACK TEST

Localized dye attack was tested by placing a 3 gram sample of a chlorine-containing detergent (generally 1.12% available chlorine) between 2 prewashed swatches of 100% cotton denim (15×15 cm) in a one liter beaker. A 500–600 ml portion of water was then added to the beaker and the beaker allowed to stand for 90 seconds at 35° C.–40° C. A numerical rating system was designed to record the extent (area) and intensity (color change) of the bottom swatch. To record the area affected, a transparent grid of 5 mm squares was placed over the swatch and a number of squares with visible attack counted. Over 70 yielded a one rating; 50–69, a two rating; 30–49, a three rating; 10–29, a four rating; and less than 10, a five rating. Intensity measurements were more subjective, but again a five rating was given to the most desirable (no visual change) and lower ratings to more intense dye attack. Data is reported as the average of the intensity and extent rating.

| The detergent formulation had the following compositions: | |
|---|---|
| Sodium Tripolyphosphate: | 22% |
| Surfactants: | 17% |
| Sodium Sulfate: | 38% |
| Sodium Carbonate: | 2% |
| Silicate Solids: | 10% |
| Carboxymethyl Cellulose: | 1% |
| Moisture: | 10% |

TEA STAIN REMOVAL TEST

Terg-O-Tometer® tests were performed using detergent solutions prepared as above containing 1.5 g/1 of detergent powder and a 16 and 32 mg/1 available chlorine. These formulations were compared to each other and to a control formulation of 1.5 g of the detergent powder. The temperature was 40° C. (105° F. ) using hard water (68 and 136 mg/1 hardness) and a washing time of 15 minutes. The tests were performed on cotton and cotton polyester blend (10×12.5 cm) swatches that had been stained with tea and heat set in a clothes dryer for 45 minutes prior to rinsing. Stain removal was reported as the change in the whiteness index (ΔWI) of the swatches. This is found by taking the L, a, and b, readings from a Hunter D25 Reflectometer® before and after washing and applying them to the following equations:

$$WI = L + 3\,(a - b)$$

$$WI = WI_{after} - WI_{before}$$

EXAMPLE 1

A dry mix was prepared containing 244.8 g anhydrous sodium carbonate, 133.4 g sodium dichloroisocyanurate dihydrate ($NaDCC.2H_2O$) and 66.3 g disodium octaborate tetrahydrate in a rotary mixer/agglomerator 8 inches in diameter with four flights normal to the shell.

A commercial aqueous sodium silicate solution (8.90% $Na_2O$, 28.7% $SiO_2$) was diluted with water to 21.5% $SiO_2$ and heated to 70° C. to facilitate spraying. A hot air stream was directed into the mixer while silicate was being sprayed onto the showering material and the bed. The resulting agglomerated material was scalped of the particles greater than 2 mm and dried in a fluid bed dryer at 35° C. for 30 minutes.

A portion of the agglomerated material was put back into the rotary drum and was sprayed with more of the aqueous silicate solution scalped of the plus 2 millimeter material and dried under the same conditions.

Sieve analysis of the initial materials indicated 70% of the sodium carbonate was between 100 and 200 μm; 70% of the borate salt was less than 44 μm and 70% of the $NaDCC.2H_2O$ was between 200 and 600 μm.

Both the single and double agglomerated materials were evaluated for bleach safety (Localized Dye Attack Test) and storage stability. As shown in Table I, the double agglomerated material was clearly superior to the single agglomerated material in both respects.

The samples were also evaluated using the Tea Stain Removal Test using cotton and polyester-cotton blends (PE Blend). The results are shown in Table II. Comparison tests were made using detergent alone (Blank), a composition containing a N–H compound as described in U.S. Pat. No. 4,279,764 (Comparative), and the detergent plus $NaDCC.2H_2O$ (No Coating).

Table II clearly shows the superiority of both the double coated and the single coated agglomerates compared with a detergent alone (Blank was run in duplicate) or the agglomerated material of U.S. Pat. No. 4,279,764 (Comparative). At 16 mg/1 available chlorine, there is evidence that the extra sodium carbonate, sodium silicate, and sodium borate compounds provide an added detergency to improve the performance of the double coated material compared with the single coated material. At higher level (32 mg/1) of available chlorine, there is an indication that the added boric acid salt mitigates the hypochlorite activity. This effect is noted in spite of the increased detergency of the double agglomerated material, thereby indicating, that if used in excess of the suggested level, the double agglomerated material is unlikely to cause as much fabric damage as the single agglomerated material.

EXAMPLE 2

Single coated agglomerates were prepared using different sodium polyborate salts, such as disodium tetraborate pentahydrate (Borax-5 Mol) and disodium octaborate tetrahydrate blended with Borax 5-Mol (Borax Blend). These agglomerates were compared using the localized dye test and the results are presented in Table III.

For comparative purposes, a dry blend was also evaluated. The dry blend (Dry Blend) contained 32.7% soda ash, 17.9% sodium dichloroisocyanurate dihydrate, 8.9% disodium octaborate tetrahydrate, and 40.5% hydrous sodium silicate (mol ratio 3.22). The Dry Blend corresponded to the double agglomerated composition of Example 1 which had an overall rating of 5.

Pursuant to the requirements of the patent statutes, the principle of this invention has been explained and exemplified in a manner so that it can be readily practiced by those skilled in the art, such exemplification, including what is considered to represent the best embodiment of the invention. However, it should be clearly understood that, within the scope of the appended claims, the invention may be practiced by those skilled in the art, and having the benefit of this disclosure, otherwise than as specifically described and exemplified herein.

TABLE I

Comparison of Single and Double Coated Agglomerates

| | Coating | |
|---|---|---|
| | Single | Double |
| Dye Attack No. | 3.5 | 5.0 |
| Stability after: | | |
| 10 days at ambient temperature | 98.4% | 100% |
| 13 days at ambient temperature | 95.4% | 100% |
| 240 days at ambient temperature | ND* | 85% |
| 510 days at ambient temperature | ND* | 70% |
| Assay: | | |
| Sodium Carbonate | 39.9% | 32.7% |
| $NaDCC.2H_2O$ | 21.8% | 17.9% |
| Disodium Octaborate Tetrahydrate | 10.9% | 8.9% |
| Sodium Silicate & Moisture | 27.4% | 40.5% |

*ND - Not Determined

TABLE II

Tea Stain Removal Test

| | Avail. Chlor. mg/l | Tea Stain Removal 68 mg/l Cotton | Hardness PE Blend | 136 mg/l Cotton | Hardness PE Blend |
|---|---|---|---|---|---|
| Blank | — | 6.0 | 0.4 | 5.4 | −0.3 |
| Blank | — | 4.5 | −0.6 | 1.2 | −3.9 |
| Comparative | 16 | 5.3 | −1.4 | 6.4 | −2.1 |
| Single Coating | 16 | 12.7 | 3.0 | 10.1 | 2.6 |
| Double Coating | 16 | 14.0 | 3.4 | 9.1 | 0.5 |
| No Coating | 16 | 12.2 | 3.5 | 9.7 | −0.1 |
| Comparative | 32 | 12.5 | 3.7 | 11.5 | 2.3 |
| Single Coating | 32 | 16.5 | 11.8 | 15.0 | 10.9 |
| Double Coating | 32 | 17.0 | 10.3 | 14.0 | 8.9 |
| No Coating | 32 | 18.1 | 10.8 | 16.1 | 8.6 |

TABLE III

Localized Dye Attack Using Different Borates

| Sample | Extent | Intensity | Rating |
|---|---|---|---|
| Borax-5 Mol | 2 | 3 | 2.5 |
| Metaborate | 3 | 3 | 3.0 |
| Borax Blend | 5 | 4 | 4.5 |
| Dry Blend | 2 | 1 | 1.5 |

What is claimed is:

1. A fabric bleach composition which minimizes localized attack on fabrics and dyes by available halogen comprising particles of a halogen bleaching agent having at least one N-halo atom capable of releasing a hypohalite ion to an aqueous solution, said particles coated with sufficient soluble, hydrated silicate-bound inorganic salt selected from the group consisting of sodium carbonate, trisodium phosphate, disodium phosphate, sodium sulfate, and condensed polyphosphates in admixture with a soluble alkali metal salt of boric acid, whereby ratio of the N-halo atoms to the boron atoms in the composition ranges from about 0.5:1 to about 10:1.

2. The composition of claim 1 wherein the halogen bleaching agent is an isocyanurate bleaching agent having at least one N-halo atom capable of releasing a hypohalite ion.

3. The composition of claim 1 wherein the halogen bleaching agent is a chlorinated cyanurate salt or hydrated salt.

4. The composition of claim 1 wherein the halogen bleaching agent is sodium dichloroisocyanurate or a hydrate thereof.

5. The composition of claim 1 where the alkali metal salt of boric acid is a sodium polyborate.

6. The composition of claim 1 wherein the alkali metal salt of boric acid is selected from the group consisting of disodium tetraborate pentahydrate, disodium tetraborate tetrahydrate, sodium pentaborate pentahydrate, sodium metaborate tetrahydrate, sodium metaborate dihydrate, disodium octaborate tetrahydrate, and mixtures thereof.

7. The composition of claim 4 wherein the alkali metal salt is selected from the group consisting of disodium tetraborate pentahydrate, disodium tetraborate tetrahydrate, sodium pentaborate pentahydrate, sodium metaborate tetrahydrate, sodium metaborate dihydrate, disodium octaborate tetrahydrate, and mixtures thereof.

8. The process of preparing a stable halogen bleach system providing minimized local fabric attack comprising:

(a) forming a dry mix consisting essentially of an H-halo bleaching agent, soluble hydratable inorganic salt selected from the group consisting of sodium carbonate, trisodium phosphate, disodium phosphate, sodium sulfate, and condensed polyphosphates, and sufficient alkali metal salt of boric acid whereby the mol ratio of N-halo atoms to boron atoms in the composition is between 0.5:1 and 10:1, (b) adding with agitation to said dry mix an aqueous solution of an alkali metal silicate to induce agglomeration thereby producing particles of N-halo bleaching agent coated with a layer containing both a soluble, hydrated silicate bound inorganic salt and an alkali metal salt of boric acid, (c) drying the particles from step (b).

9. The process of claim 8 in which a second coating is applied to the N-halo bleaching agent by forming a second dry mix of the particles from claim 8 and adding with agitation to said dry mix an aqueous solution of an alkali metal silicate thereby producing further silicate binding of the soluble, hydrated, inorganic salt and the alkali metal salt of boric acid, and drying the particles.

10. The process of claim 8 wherein the N-halo bleaching agent is a chlorinated cyanurate salt or hydrate thereof.

11. The process of claim 8 wherein the N-halo bleaching agent is sodium dichloroisocyanurate or hydrate thereof.

12. The process of claim 8 wherein the alkali metal salt of boric acid is a sodium polyborate.

13. The process of claim 8 wherein the alkali metal salt is selected from the group consisting of disodium tetraborate pentahydrate, disodium tetraborate tetrahydrate, sodium pentaborate pentahydrate, sodium metaborate tetrahydrate, sodium metaborate dihydrate, disodium octaborate tetrahydrate, and mixtures thereof.

14. The process of claim 9 wherein the N-halo bleaching agent is a chlorinated cyanurate salt or a hydrate thereof.

15. The process of claim 9 wherein the N-halo bleaching agent is sodium dichloroisocyanurate or hydrate thereof.

16. The process of claim 9 wherein the alkali metal salt is selected from the group consisting of disodium tetraborate pentahydrate, disodium tetraborate tetrahydrate, sodium pentaborate pentahydrate, sodium metaborate tetrahydrate, sodium metaborate dihydrate, disodium octaborate tetrahydrate, and mixtures thereof.

17. A detergent composition consisting essentially of the following by weight:

(a) from 5% to 50% of an available halogen bleach composition comprising an available halogen bleach composition suitable for use in laundries to minimize localized attached on fabrics and dyes comprising particles of a halogen bleaching agent having at least one N-halo atom capable of releasing a hypohalite ion to an aqueous solution, said particles coated with sufficient soluble, hydrated, silicate-bound inorganic salt selected from the group consisting of sodium carbonate, trisodium phosphate, disodium phosphate, sodium sulfate, and condensed phosphates, in admixture with a soluble alkali metal salt of boric acid, whereby ratio of the N-halo atoms to the boron atoms in the composition is between 0.5:1 and 10:1, (b) from about 5% to 50% of a detergent agent, and (c) from 17% to 60% of a detergency builder.

18. The detergent composition of claim 17 wherein the available halogen compound is a chlorinated cyanurate salt or hydrate.

19. The detergent composition of claim 17 wherein the alkali metal salt is selected from the group consisting of disodium tetraborate pentahydrate, disodium tetraborate tetrahydrate, sodium pentaborate pentahydrate, sodium metaborate tetrahydrate, sodium metaborate dihydrate, disodium octaborate tetrahydrate, and mixtures thereof.

20. The detergent composition of claim 18 wherein the alkali metal salt is selected from the group consisting of disodium tetraborate pentahydrate, disodium tetraborate tetrahydrate, sodium pentaborate pentahydrate, sodium metaborate tetrahydrate, sodium metaborate dihydrate, disodium octaborate tetrahydrate, and mixtures thereof.

* * * * *